United States Patent [19]

Melzer

[11] 4,264,068

[45] Apr. 28, 1981

[54] MECHANISM FOR THE LATERAL ALIGNMENT OF SHEETS ON FEED TABLE

[75] Inventor: Rudolf Melzer, Hainburg, Fed. Rep. of Germany

[73] Assignee: M.A.N.-Roland Druckmaschinen Aktiengesellschaft, Fed. Rep. of Germany

[21] Appl. No.: 94,697

[22] Filed: Nov. 16, 1979

[30] Foreign Application Priority Data

Dec. 1, 1978 [DE] Fed. Rep. of Germany ..... 2851935

[51] Int. Cl.[3] ..... B65H 9/10

[52] U.S. Cl. ..... 271/250; 271/241

[58] Field of Search ..... 271/250, 248, 241, 252, 271/249, 236, 237, 238, 226

[56] References Cited

U.S. PATENT DOCUMENTS

| | | | |
|---|---|---|---|
| 2,529,273 | 11/1950 | Albrecht | 271/241 |
| 2,798,720 | 7/1957 | Morse | 271/252 |
| 4,092,022 | 5/1978 | Preuss et al. | 271/252 X |
| 4,164,349 | 8/1979 | Marass | 271/250 |
| 4,188,027 | 2/1980 | Naumann | 271/250 X |

FOREIGN PATENT DOCUMENTS

| | | | |
|---|---|---|---|
| 1072913 | 6/1967 | United Kingdom | 271/195 |

*Primary Examiner*—Bruce H. Stoner, Jr.

*Attorney, Agent, or Firm*—Leydig, Voit, Osann, Mayer & Holt, Ltd.

[57] ABSTRACT

A side lay assembly for lateral registration of sheets fed periodically along the surface of the feed table of a printing press. A sucker having a sucking surface flush with the feed table is slidably mounted on a sucker tube for movement toward and away from the table side guide. A side lay drive shaft, coupled to the press drive, is spaced below the sucker and parallel with the tube. A cam on the shaft engaging a cam follower on the sucker causes the sucker to move toward the side guide timed with the arrival of a sheet. An air valve is provided in the form of a valve disc close coupled to the cam for connecting the sucker tube to a source of suction in phase with lateral movement of the sucker so that the arriving sheet is urged into engagement with the side guide. To vary the degree of suction an adjustable bleed valve is interposed between the air valve and the source of suction. The sucker is of composite construction having a hollow body and a head, the head being removable from the body for replacement by a head having a different surface or set of apertures.

3 Claims, 3 Drawing Figures

MECHANISM FOR THE LATERAL ALIGNMENT OF SHEETS ON FEED TABLE

In a sheet-fed printing press sheets pass one by one the length of the feed table. Exact register of a sheet in the direction of flow is achieved by a front stop. To register the sheet in the lateral direction it is known to provide a side guide with a reciprocating suction head, flush with the table, to which suction is applied timed with arrival of a sheet to move the sheet against the guide.

In spite of the great amount of attention which has been given to the problem of register over the years, the devices commercially available for this purpose are generally unsatisfactory in operation, particularly at high speed, of such large size as to be cumbersome, and quite expensive. For example, in German Auslegeschrift No. 26 47 795 which was laid open July 13, 1978 there is shown a sucker which is swung back and forth on a cam-controlled swing arm which results in the sucker following a circular path, which is undesirable, instead of a straight path. In such construction the movement of the sucker is stopped by engagement of the edge of the sheet with the side guide, with overtravel of the sucker linkage being accommodated by a compression spring. This requires that the force of the spring be adjusted each time the thickness or other characteristic of the paper is changed. Moreover, since the sucker is arranged below the level of the table, and cannot perform its function until the paper is actually in suction engagement, the air requirement of the device is inordinately high. Nor is the arrangement there shown capable of handling papers having widely different characteristics since there is no possible variation of either suction area or degree of suction. The mechanism is far from compact; for example, a long hose connection is required to cover the distance from the valve to the sucker. Finally, the prior device requires a hold-down, adding to its complexity.

It is, in contrast to the above, an object of the present invention to provide a side lay assembly which is of simple, economical and highly compact construction, which is completely reliable even at highest press speeds, which uses a minimum quantity of air per cycle and which may be used universally for sheets having a wide range of thickness, stiffness and surface characteristics. Different suction heads may be easily and quickly substituted to vary the number of suction openings as well as their size and distribution. The degree of suction may be readily adjusted and, once set, remains adjusted to produce the desired degree of drag on a sheet while accommodating intentional overtravel.

Other objects and advantages of the invention will become apparent upon reading the attached detailed description and upon reference to the drawings in which.

Figure 1:
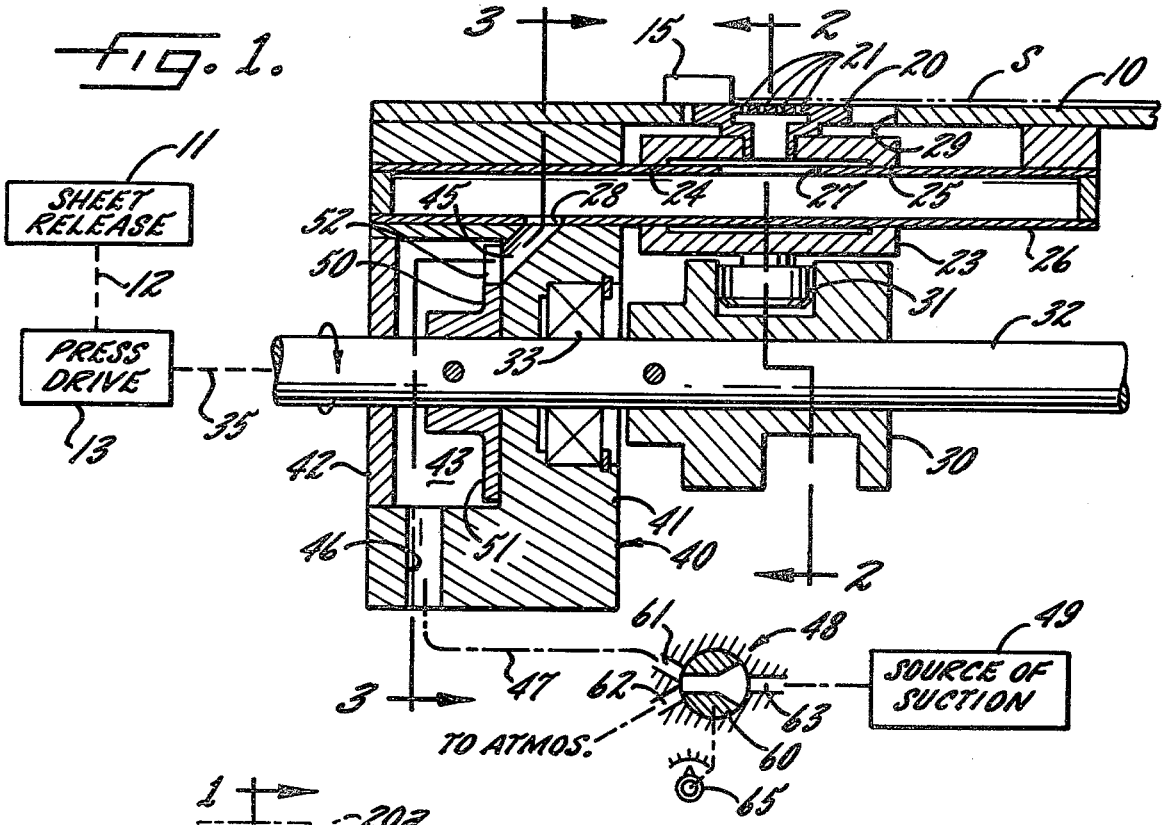
FIG. 1 shows in section a side lay assembly constructed in accordance with the present invention, as viewed along line 1—1 in FIG. 2.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Turning now to the drawings there is shown in vertical section a portion of a feed table having a supporting surface 10 over which a sheet S travels following release by a release mechanism 11 having a synchronized drive connection 12 with the press drive 13. As is conventional with feed tables, forward passage of the sheet is limited by engagement with a front stop (not shown) to provide register in the line of travel, while side register, or "side lay", is achieved by engagement of the sheet with the side guide 15. When contact has been simultaneously achieved at the front stop and side guide, the leading edge of the sheet is gripped by a transfer mechanism (not shown) which conveys the sheet in its registered state to the surface of an impression cylinder where the printed impression is applied.

For the purpose of engaging the underside of the sheet and for moving it toward the side guide 15, a sucker head 20 is provided having an upper surface which is flush with the table surface and which includes a two-dimensional pattern of suction apertures 21 which communicates with a hollow neck 22. The neck of the sucker head communicates with a hollow sucker body 23 having aligned openings 24, 25 in its respective ends to permit telescoping over a stationary sucker tube 26. The tube has an inlet opening 27 and an outlet opening 28. The tube serves as a way surface for the reciprocating movement of the sucker, the tube and sucker body being so constructed as to provide vacuum to the sucker head over the entire range of reciprocating movement. The reciprocating movement of the head is accommodated by an oversize opening 29 in the table.

For imparting the reciprocating movement, a repeating helical cam 30 is provided which engages a cam follower in the form of a roller 31 secured to the underside of the sucker body. The cam 30 is pinned to a shaft 32 which lies below, and extends parallel to, the tube 26. The cam shaft 32 projects through an adjacent wall of a valve body, being rotatably supported therein on a bearing 33. The end of the shaft 32 has a connection 35 to the press drive 13.

The valve body indicated at 40 has an inner wall 41, which contains the bearing, and an outer wall 42 which, together, define a suction chamber 43. The suction chamber has an inlet port 45 and an outlet port 46, the latter being connected by a suction line 47 to an adjusting valve 48 which is in turn connected to a source of suction 49.

For the purpose of applying suction to the head 20 in synchronism with movement of the head toward the side guide 15, a valve disc 50 is provided on the inside surface of the wall 41 of the valve housing, the valve disc having a closed sector 51 and an open sector 52 which alternately open and close the inlet port 45 which leads to the sucker tube.

In operation, the drive shaft 32 is rotated by the press drive in a direction of the arrows to block the valve port 45. Thus no further suction is applied as the suction head undergoes its return movement away from the side guide 15. The engaged sheet is sufficiently porous so that residual vacuum is almost immediately dissipated, but, if not, the tube 26 may, if desired, be provided with a leak to the atmosphere.

After the cam 30 has reached its opposite extreme of movement, the motion of the head reverses and the head begins to move toward the side guide timed with the arrival of a sheet released by the mechanism 11. Shortly after the sucker head begins its leftward movement, the valve port 45 is uncovered by the open sector 52 of the valve disc, which causes immediate application of vacuum to the sucker tube and therefore immediate engagement of the newly arrived sheet, carrying it in the direction of the side guide until edge contact takes place. Following such contact, the sucker head overtravels slightly, with such overtravel being accommodated by the fact that the suction head, subjected to only a light degree of suction, provides an impositive mechanical connection with the sheet.

Thus it is one of the features of the present device that an adjustable bleed valve is interposed between the valve disc 50 and the source of suction 49, thereby enabling the precise degree of suction to be achieved which is optimum for the gauge and stiffness of the paper being handled. The valve 48 is of the "sharing" type, including a rotor 60, a working inlet port 61, an atmospheric inlet port 62 and an outlet port 63. The rotor is settable by a manual control knob 65. It will be seen that in the position shown a substantial amount of atmospheric air is bled into the system causing a relatively limited vacuum to be applied to the working port 61. Clockwise rotation of the knob increases the cross section available to the working air, while progressively throttling the atmospheric air, to raise the level of suction in the system. Conversely, rotation of the manual knob to the left causes an increasing amount of the inlet air to come from the atmosphere and a reduced amount of the air to be drawn from the system, thereby reducing the degree of suction.

Figure 2:
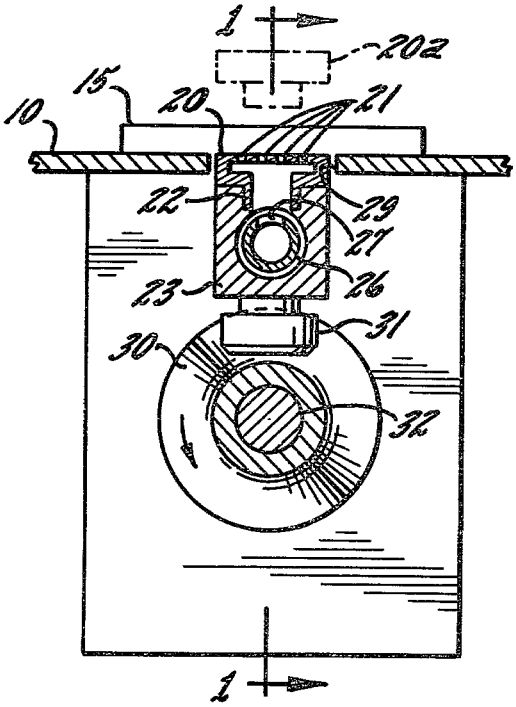
FIG. 2 is a transverse section looking along line 2—2 in FIG. 1.
Figure 3:
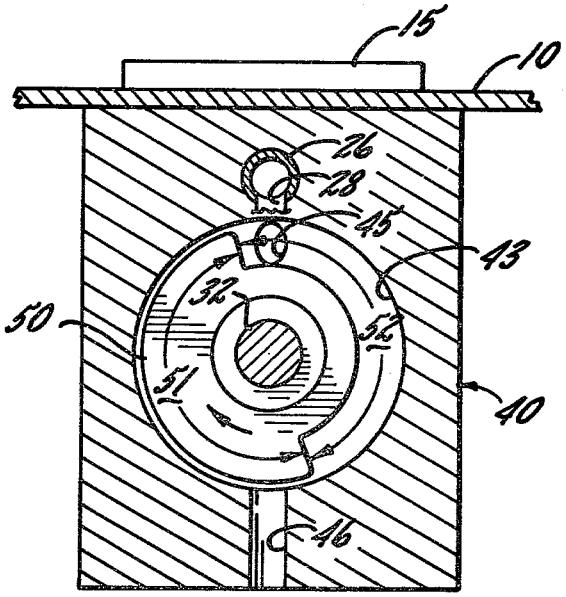
FIG. 3 is another transverse section, looking in the opposite direction, along line 3—3 in FIG. 1.

As a further mode of control to adapt the device to sheets of widely different weight, stiffness, porosity and surface finish, the suction head 20 is easily removable from the body 23 by reason of the disengageable neck or slip joint 22. It is a simple matter, with the head moved all of the way in its retracting direction, to lift the head (20*a* in FIG. 2) out of its recess 29, replacing it with a head having a different size or distribution of inlet ports or a head differently surfaced to provide a different amount of friction for a given degree of suction.

It will be apparent that the construction just described amply fulfills the objects for which it was designed. The device consists of a minimum number of parts and those are of simple, easily formed shapes. Indeed, it is contemplated that the parts be made of plastic by the injection molding technique so that little if any machining of metal is required. The device is highly compact, with the two operating parts, the cam and the valve disc, being closely spaced on the same shaft and on opposite sides of the same wall. There is no necessity for using hoses within the device; indeed, the suction chamber and suction tube, which directly supplies the head, are spaced apart by a distance which is only about twice the thickness of the valve disc.

The device is easy to adjust, first by choice of suction head and secondly by moving the vacuum control knob without any necessity for adjusting mechanical elements such as springs; nor need any special mechanical provision be made for overtravel of the head. The motion is directly at right angles with respect to the side guide, not through an arc. The parts being simple and light, close coupled and perfectly synchronized, reliable operation is achieved up to the highest press operating speeds. Because of the lack of close tolerances and freedom from lubrication problems, trouble-free operation with no maintenance is to be expected over long periods of time.

The device is highly efficient, providing immediate engagement of the sheet as soon as suction is applied so that minimum air is required per cycle, and no hold-down provision is necessary.

What I claim is:

1. In a side lay assembly for the registered feeding of sheets in a printing press having a press drive, the combination comprising a feed table, means coupled to the press drive for releasing sheets periodically for movement along the surface of the feed table, a side guide at the edge of the feed table, a sucker having a sucking surface flush with the feed table and adjacent the side guide, a horizontal sucker tube below the feed table and forming a way surface for mounting the sucker for movement toward and away from the side guide, the tube being in communication with the sucker throughout the latter's range of movement, a side lay drive shaft coupled to the press drive and spaced below the sucker and parallel with the tube, a cam on the shaft and a cam follower on the sucker coupled together so that the sucker moves toward the side guide timed with the arrival of a sheet, a source of suction, an air valve having an inlet connected to the tube and an outlet connected to the source of suction, the air valve including a valve disc on the shaft, the valve disc having an opening phased with the movement of the sucker toward the side guide so that the arriving sheet is urged into engagement with the side guide, and means for varying the degree of suction, the air valve having a housing defining a suction chamber and including a wall through which the drive shaft projects, the wall having a passage communicating with the tube, the cam being located on the outside of the wall and the valve disc being located on the inside of the wall so that air is admitted through the passage synchronized with the movement of the cam.

2. In a side lay assembly for the registered feeding of sheets in a printing press having a press drive, the combination comprising a feed table, means coupled to the press drive for releasing sheets periodically for movement along the surface of the feed table, a side guide at the edge of the feed table, a sucker having a sucking surface flush with the feed table and adjacent the side guide, a horizontal sucker tube below the feed table and forming a way surface for mounting the sucker for movement toward and away from the side guide, the tube being in communication with the sucker throughout the latter's range of movement, a side lay drive shaft coupled to the press drive and spaced below the sucker and parallel with the tube, a cam on the shaft and a cam follower on the sucker coupled together so that the sucker moves toward the side guide timed with the arrival of a sheet, a source of suction, an air valve having an inlet connected to the tube and an outlet connected to the source of suction, the air valve including a valve disc on the shaft, the valve disc having an opening phased with the movement of the sucker toward the side guide so that the arriving sheet is urged into engagement with the side guide, and means for varying the degree of suction, the means for varying the degree of suction being in the form of a three-way adjustable bleed valve having a first inlet port connected to the outlet of the air valve, a second inlet port open to the ambient atmosphere, and an outlet port connected to the source of suction.

3. In a side lay assembly for the registered feeding of sheets in a printing press having a press drive, the combination comprising a feed table, means coupled to the press drive for releasing sheets periodically for movement along the surface of the feed table, a side guide at the edge of the feed table, a sucker head recessed in the feed table adjacent the side guide and having a sucking surface flush with the feed table, a frame on the underside of the feed table having a vertical wall extending downwardly therefrom, a sucker tube mounted in the frame below the feed table parallel thereto and forming a way surface for the sucker head, the sucker head being of hollow construction and having a pair of horizontally alined openings in telescoping relation with the sucker tube for movement of the sucker head toward and away from the side guide while maintaining the sucking surface in its flush condition throughout its range of movement, the tube having a lateral opening providing communication with the sucker head throughout the latter's range of movement, a side lay drive shaft coupled to the press drive and spaced below the tube and parallel with it, the shaft extending through and journaled in the wall of said frame, a continuous helical cam on the shaft on one side of the wall, a cam follower on the sucker head and projecting downwardly therefrom for engaging the cam so that the sucking surface moves toward the side guide timed with the arrival of a sheet, a source of suction, an air valve having an inlet connection extending through the wall to the interior of the tube and an outlet connected to the source of suction, the air valve including a valve disc secured to the shaft on the opposite side of the wall, the valve disc lying flatly adjacent the wall and having closed and open sectors for covering and uncovering the inlet connection in the wall phased with the movement of the sucking surface toward the side guide so that the arriving sheet is urged into engagement with the side guide, and means for varying the degree of suction to a level which provides an impositive wiping engagement between the sucking surface and the sheet thereby to permit overtravel of the sucker head following engagement of the edge of the sheet with the side guide.

* * * * *